United States Patent [19]

Jobe, II

[11] 4,187,589

[45] Feb. 12, 1980

[54] SLOTTING FASTENER DRIVING DEVICE

[76] Inventor: William T. Jobe, II, 2263 Swings Corner Rd., Bethel, Ohio 45106

[21] Appl. No.: 881,413

[22] Filed: Feb. 27, 1978

[51] Int. Cl.[2] ..... B25C 1/04

[52] U.S. Cl. ..... 227/66; 227/76

[58] Field of Search ..... 227/66, 76

[56] References Cited

U.S. PATENT DOCUMENTS

| | | | |
|---|---|---|---|
| 3,650,452 | 3/1972 | Finke | 227/76 X |
| 3,774,293 | 11/1973 | Golsch | 227/66 X |

*Primary Examiner*—Paul A. Bell

[57] ABSTRACT

This disclosure relates to a fastener driving device which produces a slot around a shank of the fastener as it is being driven. It is useful in a situation where a sheet material which is subject to expansion and contraction is to be fastened to a base and wherein movement resulting from expansion and contraction must be permitted to avoid buckling. The invention resides specifically in the guide body and driver element of the tool in that the driver element is T-shaped in cross section with the central portion of the T constituting the driver proper and the portions extending laterally from the central portion terminating below the bottom of the driver proper and having a recess extending from the bottom of the driver proper through the length of said punch into which the shank of a fastener may be pushed. In this way as the fastener is driven into the base through the sheet material, a slot is formed extending to both sides of the shank of the fastener.

12 Claims, 12 Drawing Figures

SLOTTING FASTENER DRIVING DEVICE

BRIEF SUMMARY OF THE INVENTION

While the invention is useful in any situation where a sheet of material, which expands and contracts with changes in temperature, must be fastened to a base while being permitted to move with respect to the base as it expands and contracts, the invention is particularly designed and will be described specifically in connection with the problem of fastening aluminum and vinyl siding to the studs of a building. The practice at the present time involves preslotting the siding at the factory. The slots, which are of course parallel to the length of the siding, are disposed at intervals which correspond to the spacing of the studs in the building to which the siding is to be attached. The nails or other fasteners are then driven through these slots and into the studs and the siding is then held in place but may move longitudinally as it expands and contracts.

As a practical matter, however, the prepunched slots do not always line up with the studs. The installers in this situation will drive the fastener through non-slotted portions of the siding into the stud and then of course the siding is trapped against the stud and cannot move as it expands and contracts and the siding then buckles. This has been a very serious problem and there has been no sound solution to it.

According to the present invention the siding is fastened to the studs by means of staples with one leg of the staple entering the stud directly beyond the edge of the siding and the other leg of the staple passing through a slot in the siding. The tool of the present invention is arranged to drive the staple and concurrently punch out a slot around the leg of the staple which passes through the siding. The tool is also designed so that the staple is not driven home tight against the siding whereby it would be trapped and as a result the siding is held in place securely but is completely free to move longitudinally as the material of the siding expands and contracts.

BRIEF DESCRIPTION OF THE SEVERAL FIGURES OF THE DRAWING

FIG. 12 is a perspective view of the driver-punch combination.

DETAILED DESCRIPTION

Figure 2:
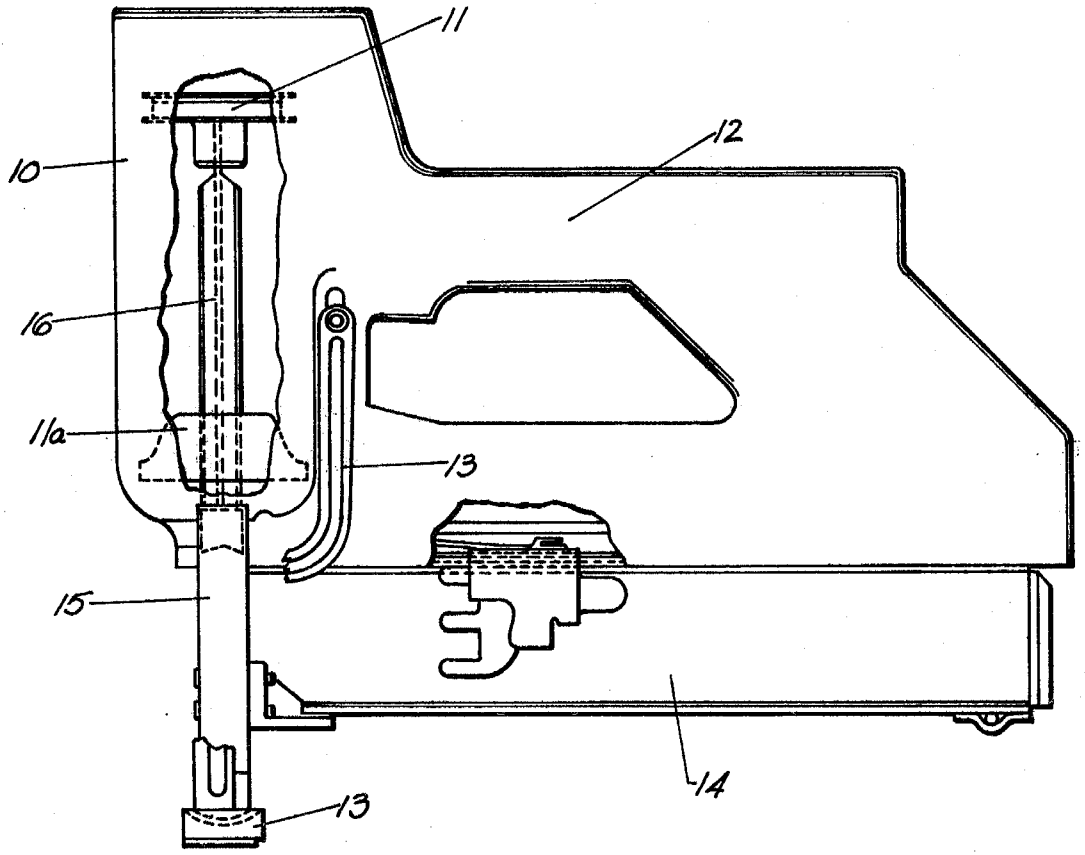
FIG. 2 is a side elevational view, with parts of the housing broken away of a typical pneumatic stapler or nailer showing only so much of the device as is necessary to an understanding of the present invention.
Figure 1:
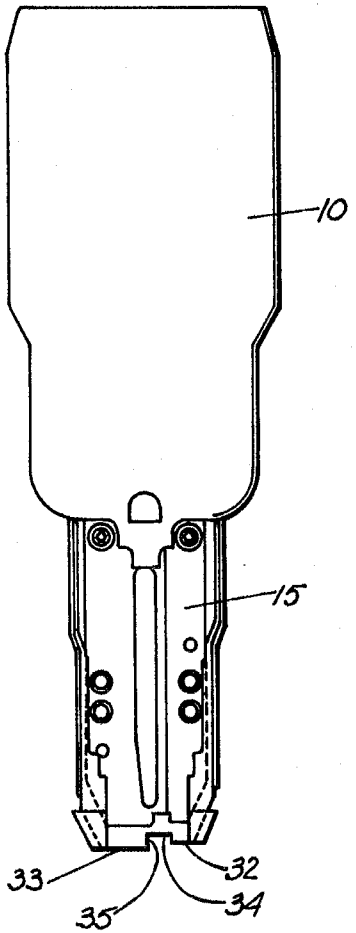
FIG. 1 is a front elevational view.
Figure 3:
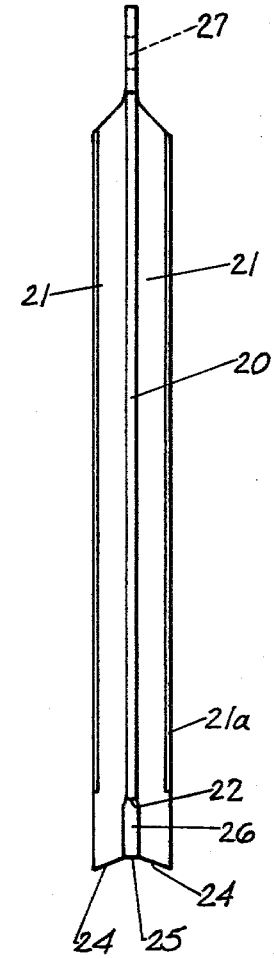
FIG. 3 is a side elevation.
Figure 4:
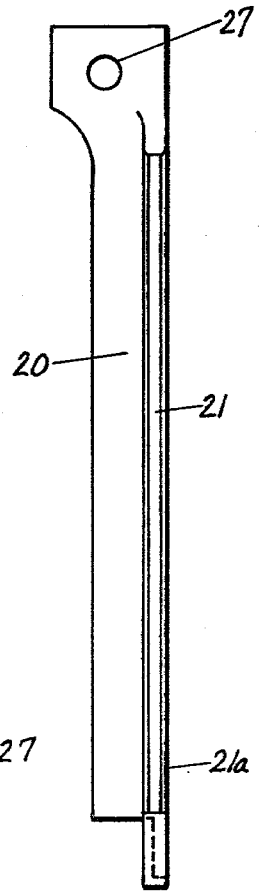
FIG. 4 is a front elevation (the words "side" and "front" being in the same relationship as in FIGS. 1 and 2) of the driver-punch combination.
Figure 1B:
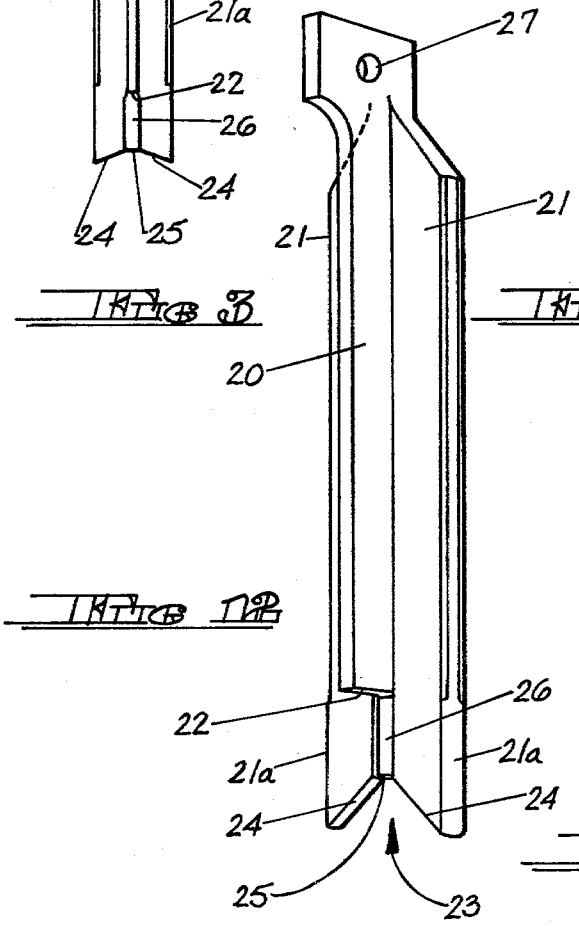
Figure 5:
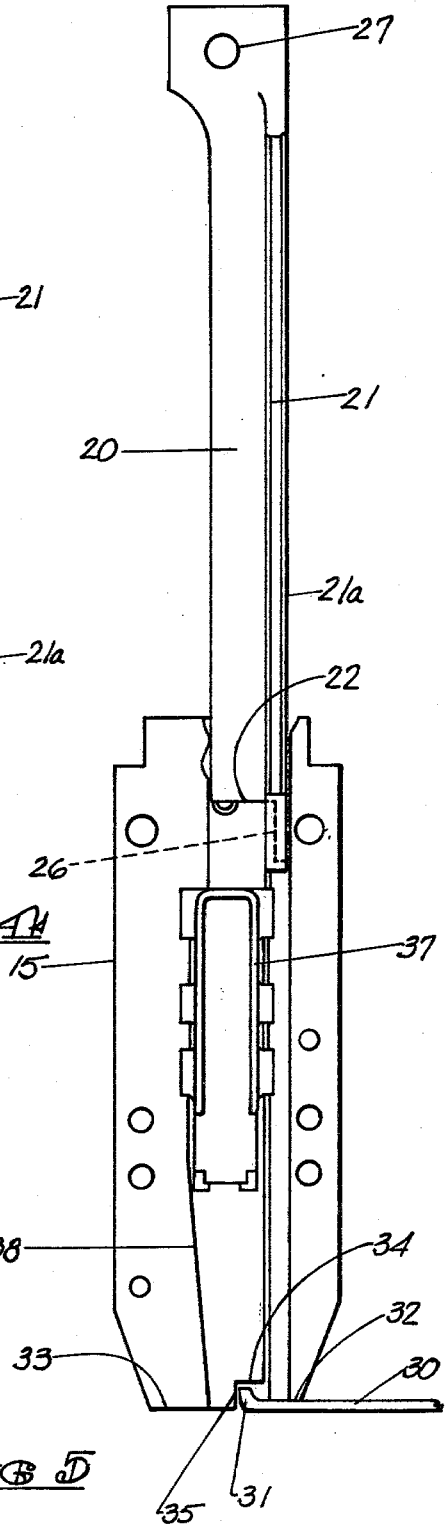
FIG. 5 is a fragmentary somewhat diagrammatic view showing the guide body and the driver-punch combination, showing the relationship of the staple in the guide body and the relationship of the tool to the siding prior to operation of the driver.

FIGS. 1 and 2 show front and side elevational views of a conventional stapler or nailer generally operated pneumatically. The details of the mechanism for operating the stapler or nailer do not form a part of the present invention and will not be described in detail.

Basically, the tool comprises a housing 10 within which there is a cylinder and a piston 11 which reciprocates therein. The tool has a handle portion 12 by means of which it is gripped and a trigger mechanism for operating the tool. The trigger mechanism is not shown and a safety device 13 is only shown partially. A magazine for staples or nails is provided as at 14 and the magazine communicates with a guide body 15, which embodies a guide track along which the driver 16 moves during the operation of stapling. The details of the tool will not be described further since the basic invention in the present case lies in the driver-punch element and the structure of the guide body.

The driver may be best visualized as seen in the perspective view of FIG. 12. The driver proper is shown at 20 and laterally extending portions 21 give the driver-punch combination a T-shaped cross section. At the bottom end of the driver is the surface 22 which engages the crown of the staple in driving the staple into the work. The extending lateral portions 21 terminate in a punch indicated generally at 23. The shape of the punch could be any of several commercially accepted and well known shapes including flat, pointed, concave, etc. The shape of the punch as described herein is that of an inverted V. The punch 23 is formed by the sloping portions 24 and it will be observed that between the apex 25 of the inverted V-shaped punch and the bottom 22 of the driver proper there is provided a recess 26 into which a leg of a staple may be pushed. The driver is, of course, provided with a hole 27 by means of which the driver is secured to the piston. It should also be noted that the portions 21 which terminate in the punch are rounded as at 21*a*, so that the slot which is punched will terminate in rounded ends.

In FIGS. 5 to 11 inclusive the action of the driver-punch combination in passing through the guide body and engaging in driving the staple is shown and for illustrative purposes the cover of the guide body has been removed. In these Figures, it is assumed that the piece of siding 30 has been placed upon the studs and that the siding has the upstanding flange 31 along its upper edge, as is conventional. It will be noted that the nose of the guide body has the portion 32 raised above the portion 33 by the thickness of the siding 30, and that a notch 34 is provided of a greater depth than the height of the upstanding flange 31. The notch 34 provides the abutment 35 against which the nose of the tool may be placed preparatory to driving the staple. The staple is indicated at 37 and it may be considered as the foremost staple in a stick of staples extending back into the magazine 14.

It will also be noted that the guide body has the slanting portion 38, the purpose of which will appear as the description proceeds.

Figures 6, 7, 8:
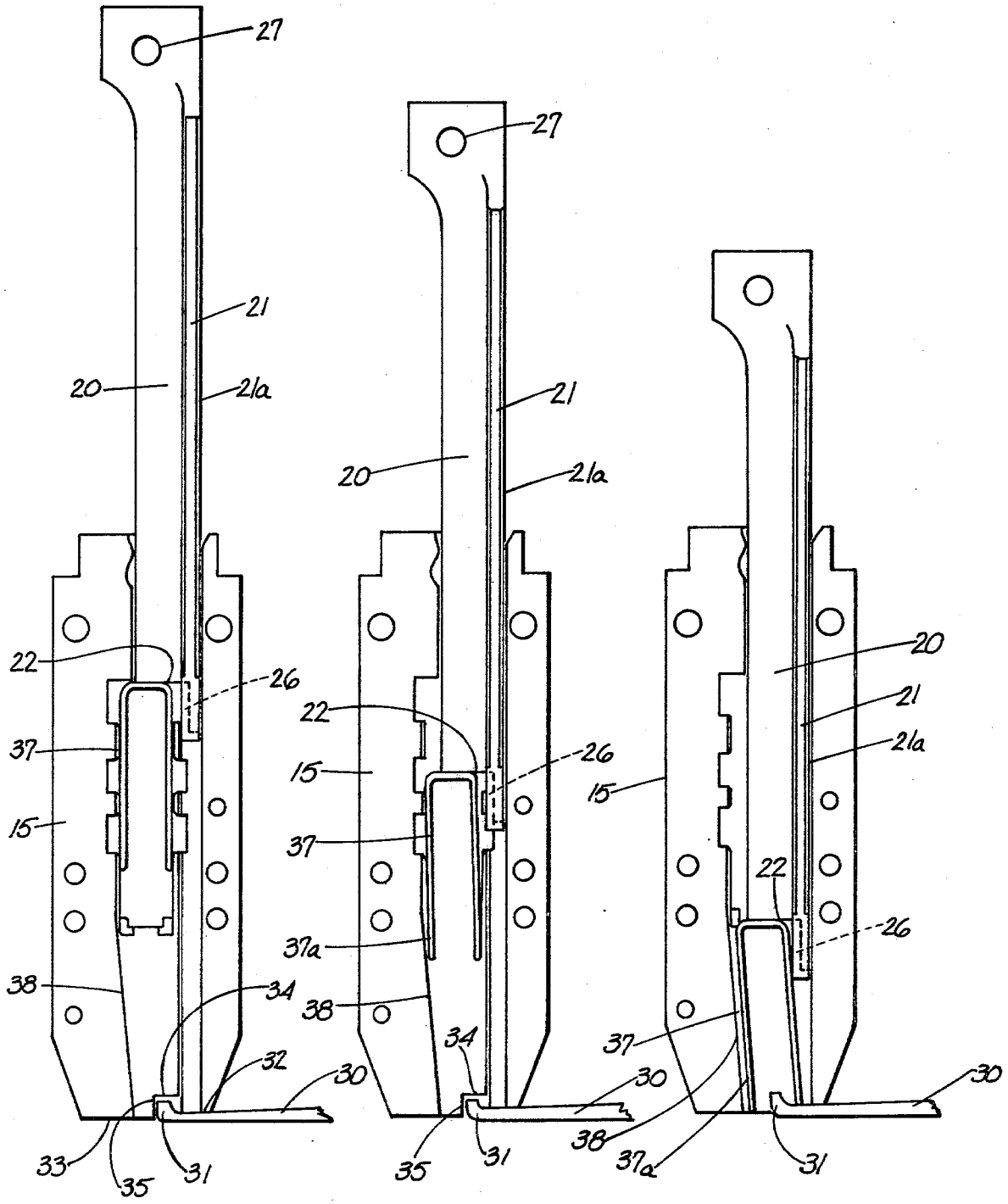
FIG. 6 is a view similar to FIG. 5, showing the driver beginning its driving stroke and picking off the leading staple from the strip of staples in the magazine.
FIG. 7 is a view similar to FIGS. 5 and 6 showing the driver moving down the guide body and pushing the staple before it and showing the staple beginning to move over under the driver by virtue of contacting the angled portion of the drive track.
FIG. 8 is a view similar to FIG. 7 showing the staple as it is about to enter the piece of siding.

Assuming now that the trigger of the tool has been actuated, the driver-punch combination begins to descend and the bottom 22 of the driver 20 picks off the foremost staple in the stick, as shown in FIG. 6.

In FIG. 7 the driver-punch combination has proceeded downward and the outer leg 37*a* of the staple 37 has begun to come into contact with the sloping portion 38 of the drive track.

In FIG. 8 the staple has reached the point of entry into the siding material 30 and the base to which it is to be attached and it will be seen that the staple is in a somewhat slanted position.

Figure 9:
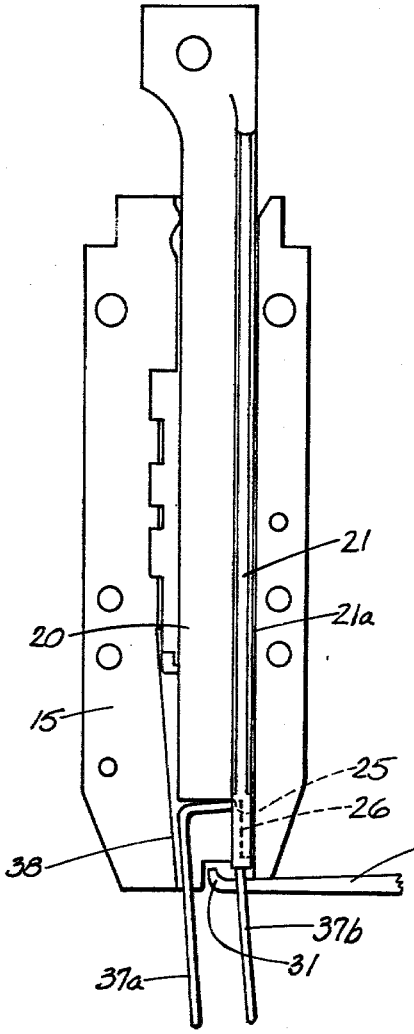
FIG. 9 is another view similar to FIG. 8 showing the staple being moved into the groove in the punch portion of the driver with the legs of the staple already driven into the base.
Figure 10:
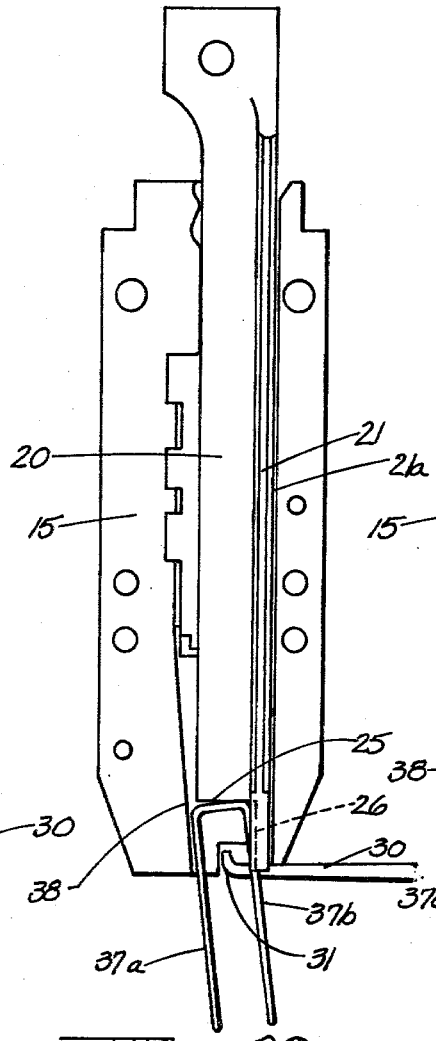
FIG. 10 is a view similar to FIG. 9 showing the punch portion of the driver beginning to punch the slot in the siding material around the staple legs.

In FIG. 9 the driver continues to descend, the slanting portion 38 of the drive track pushes the upper portion of the leg 37*b* of the staple into the recess 26, so as to bring it into the apex 25 of the inverted V-shaped punch. In FIG. 10, the inverted V-shaped punch has begun to punch out a slot in the siding 30, and by virtue of the shift of the leg 37*b* of the staple 37 into the recess 26, the slot punched by the punch will extend to both sides of the staple leg 37*b*.

Figure 11:
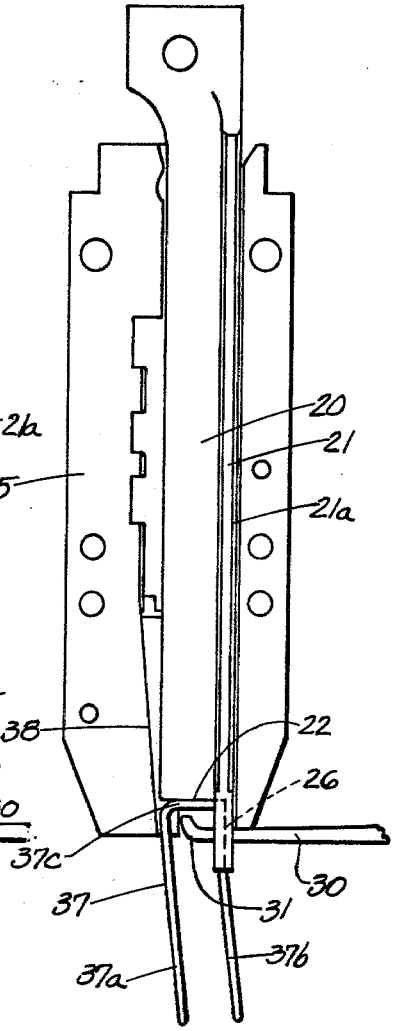
FIG. 11 shows the staple and driver punch combination in the fully driven position.

In FIG. 11 the staple 37 is driven as far as it will be driven by the driver and it will be observed that the crown 37*c* of the staple is not driven down against the upstanding flange 31. Therefore, by virtue of the fact that the flange is not trapped by the staple and that the leg 37*b* passes through a slot, the siding 30 may move in a direction perpendicular to the drawing of FIG. 11 as it expands and contracts, thereby avoiding buckling.

The depth to which the staple is driven is determined by the length of the driver proper in relation to the stroke of the piston and the location of the piston stop 11*a*. This determination is well known and within the capabilities of those skilled in the art. It is simply necessary to make the relationship between the piston and the piston stop and the length of the driver such that the crown of the staple in its fully driven condition does not bear against the upstanding flange 31.

While the invention has been described in connection with a pneumatic stapler, it should be understood that the particular instrumentality for driving the driver-punch combination is not a limitation upon the present invention and that while the invention has been described specifically with staples and specifically in connection with the fastening of siding to studs, these likewise do not constitute limitations on the invention.

It will be obvious that numerous modifications may be made without departing from the spirit of the invention and therefore no limitation not expressly set forth in the claims is intended and no such limitation should be implied.

The embodiments of the invention in which an exclusive property or privilege is claimed are defined as follows:

1. In a tool for securing a rigid sheet of material to a base so as to be slidable thereon, by means of fasteners, said tool having a guide body, a fastener driver reciprocal in said guide body, a fastener magazine, and means for feeding fasteners from said magazine to said guide body in a position to be driven by said driver, means for forming a slot in the sheet of material around the fastener shank contemporaneous with driving of the fastener.

2. A tool according to claim 1, wherein said means for forming a slot comprises portions extending laterally from said driver and terminating in a punch extending below the bottom of said driver, said punch, below said driver, having a recess into which a fastener shank may be pushed, said recess extending from the bottom of said driver along the length of said punch, said guide body having near its lower end an inwardly inclined portion, whereby, as said driver drives a fastener, the inclined portion of said guide body pushes the fastener shank into said recess, and said punch punches out a slot in said sheet of material extending to both sides of said fastener shank.

3. A tool according to claim 2, wherein said punch has the shape of an inverted V.

4. A tool according to claim 3, wherein the outer edges of said V-shaped punch are rounded, whereby the slot produced thereby is rounded at both ends.

5. In a tool for securing a sheet of material which is subject to expansion and contraction to a base by means of fasteners, said tool having a fastener magazine, a guide body, and a fastener driver reciprocable in said guide body, and means for feeding fasteners from said magazine to said guide body in a position to be driven by said driver; said driver being T-shaped in cross section, the central portion of said T constituting the driver proper, and the portions extending laterally from said central portion terminating in an inverted V-shaped punch with its apex below the bottom of said driver proper, said punch, below said driver proper, having a recess into which a fastener shank may be pushed, said recess extending from the bottom of said driver proper to the apex of said inverted V-shaped punch, said guide body having near its lower end an inwardly inclined portion; whereby, as said driver proper drives a fastener, the inclined portion of said guide body pushes the fastener shank into said recess, and said punch punches out a slot in said sheet of material extending to both sides of said fastener shank.

6. A tool according to claim 5, wherein the outer edges of said V-shaped punch are rounded, whereby the slot produced thereby is rounded at both ends.

7. In a tool for securing a sheet of material which is subject to expansion and contraction to a base by means of a staple, with one leg of the staple passing through the sheet of material adjacent an edge thereof, and the other leg entering said base beyond said edge without passing through said sheet, said tool having a staple magazine, a guide body, and a fastener driver reciprocable in said guide body, and means for feeding a staple from said magazine to said guide body in a position to be driven by said driver; said driver being T-shaped in cross section, the central portion of said T constituting the driver proper, and the portions extending laterally from said central portion terminating in an inverted V-shaped punch with its apex below the bottom of said apex proper, said punch, below said driver proper, having a recess into which a leg of a staple may be pushed, said recess extending from the bottom of said driver proper to the apex of said inverted V-shaped punch, said guide body having near its lower end an inwardly inclined portion; whereby, as said driver proper drives a staple, the inclined portion of said guide body pushes one leg of said staple into said recess, and said punch punches out a slot in said sheet of material extending to both sides of said staple leg.

8. A tool according to claim 7, wherein the outer edges of said V-shaped punch are rounded, whereby the slot produced thereby is rounded at both ends.

9. In a tool for securing siding, of a material which is subject to expansion and contraction, to the studs in a building structure by means of staples, with one leg of said staples passing through the siding adjacent an edge thereof, and the other leg entering said studs beyond said edge without passing through said siding, said tool having a staple magazine, a guide body, and a fastener driver reciprocable in said guide body, means for feeding a staple from said magazine to said guide body in a position to be driven by said driver; said driver being T-shaped in cross section, the central portion of said T constituting the driver proper, and the portions extending laterally from said central portion terminating in an inverted V-shaped punch with its apex below the bottom of said driver proper, said punch, below said driver proper, having a recess into which a leg of a staple may be thrust, said recess extending from the bottom of said driver proper to the apex of said inverted V-shaped punch, said guide body having near its lower end an inwardly inclined portion; whereby as said driver proper drives a staple, the inclined portion of said guide body pushes one leg of said staple into said recess, and said punch punches out a slot in said siding extending to both sides of said staple leg.

10. A tool according to claim 9, wherein the outer edges of said V-shaped punch are rounded, whereby the slot produced thereby is rounded at both ends.

11. A tool according to claim 9 for use with siding material having an upstanding flange along the upper edge, said guide body having a notch of a height slightly greater than the height of said flange and providing an abutment for positioning said tool to drive a staple with one leg spaced away from said upstanding flange and passing through the siding, and the other leg passing beyond said flange directly into a stud.

12. A tool according to claim 9 for use with siding material having an upstanding flange along the upper edge, said driver being connected to a piston operating in a cylinder and having a piston stop at the bottom of said cylinder, wherein the relationship between the piston and piston stop and the length of the driver is such that the crown on the staple in the fully driven condition does not bear against said flanges.

* * * * *

UNITED STATES PATENT AND TRADEMARK OFFICE

CERTIFICATE OF CORRECTION

PATENT NO. : 4,187,589

DATED : February 12, 1980

INVENTOR(S) : William T. Jobe, II

It is certified that error appears in the above-identified patent and that said Letters Patent are hereby corrected as shown below:

The designation of Assignee should appear as follows:
-- Assignee: Senco Products, Inc.,
Cincinnati, Ohio --

Signed and Sealed this

*Twenty-eighth* Day of *July 1981*

[SEAL]

*Attest:*

GERALD J. MOSSINGHOFF

*Attesting Officer*

*Commissioner of Patents and Trademarks*